US006302022B1

(12) United States Patent
Shih

(10) Patent No.: US 6,302,022 B1
(45) Date of Patent: Oct. 16, 2001

(54) INK REFILLABLE STAMP

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 09/692,225

(22) Filed: Oct. 20, 2000

(51) Int. Cl.[7] ..... B41F 13/10
(52) U.S. Cl. ..... 101/379; 101/327
(58) Field of Search ..... 101/379, 368, 101/405, 406, 333, 327, 103

(56) References Cited

U.S. PATENT DOCUMENTS 4,182,261 * 1/1980 Smith et al. ..... 101/327
4,676,162 * 6/1987 Phipps et al. ..... 101/327
5,483,880 * 1/1996 Seo et al. ..... 101/333
5,855,170 * 1/1999 Shih ..... 101/333
5,974,969 * 11/1999 Okumura et al. ..... 101/333
6,047,639 * 4/2000 Shih ..... 101/333

* cited by examiner

*Primary Examiner*—John S. Hilten
*Assistant Examiner*—Anthony H. Nguyen
(74) *Attorney, Agent, or Firm*—Rosenberg, Klein & Lee

(57) ABSTRACT

An ink refillable stamp has a cap (10), and a handle (20) mounted under the cap (10). The handle (20) has a passage (26) defined therein and a first resilient member (27) is received in the passage (26). A housing (30) has a tubular portion (31) formed on a top surface thereof and received in the passage (26). An upper seat (40) is received in the housing (30) and has a pole (41) formed on a top surface thereof and extending through the tubular portion (31) and the passage (26) and engaged in the handle (20). A lower seat (50) is detachably mounted beneath the upper seat (40) and has a plurality ink inlets (53) defined through a top surface thereof A chamber (54) is defined at a bottom portion of the lower seat (50) and in communication with the ink inlets (53). A sponge (55) is received in the chamber (54) and a stamping sheet (551) is provided under the sponge (55). A bottom cover (60) is provided on the lower seat (50).

15 Claims, 8 Drawing Sheets

INK REFILLABLE STAMP

FIELD OF THE INVENTION

1. Field of the Invention

The present invention is related to an ink refillable stamp, and more particularly to an ink refillable stamp which can be formed with any configurations of stamping sheet such as circular, rectangular, triangular and is refilled with ink easily.

2. Description of Related Art

Referring to FIGS. 8 and 9, a conventional ink refillable stamp has a handle (81) with a cap (80) mounted on a tubular portion of an outer housing (82). An inner housing (83) is received in the outer housing (82) and has a stamping body (84) mounted therein by an upper frame (841) and a lower frame (842). The stamping body (84) has a plurality of ink inlets (843) defined in an upper surface thereof and each ink inlet (843) has one of a plurality of pins (844) formed therein. A sponge (86) is provided in the stamping body (84) and a stamping sheet (87) is provided beneath the sponge (86). A bottom cover (85) is provided under the stamping body (84). The outer housing (82), the inner housing (83), the stamping body (84) are all rectangular. The outer housing (82) and the inner housing (83) have openings defined at short sides thereof. The stamping body (84) can be drawn out from the openings for ink refilling. In ink refilling, the pins pierce seals of inverted ink bottles, and ink flows into the stamping body (84) and is absorbed by the sponge (86) in the stamping body (84).

However, because the stamping body (84) is drawn out from a side of the housings (82, 83), it must be the rectangular. Thus, patterns of the conventional stamp also cannot be formed with other configuration except the rectangle. If it is possible to make other patterns such as a circle, a triangle, or a polygon on the rectangular stamping body, it is not easy for a user to position the stamp in a correct location because of the difference between the pattern and the stamping body.

Therefore, the invention provides an improved ink refillable stamp to mitigate and/or obviate the aforementioned problems.

SUMMARY OF THE INVENTION

The main objective of the present invention is to provide an ink refillable stamp which is able to be made with any configuration for correctly positioning a stamping pattern.

Another objective of the present invention is to provide an ink refillable stamp which is refilled with ink easily.

Another objective of the present invention is to provide an ink refillable stamp which can help a user correctly position the pattern.

Other objects, advantages and novel features of the invention will become more apparent from the following detailed description when taken in conjunction with the accompanying drawings.

BRIEF DESCRIPTION TO THE DRAWINGS

DETAILED DESCRIPTION TO THE PREFERRED EMBODIMENT

Figure 1:
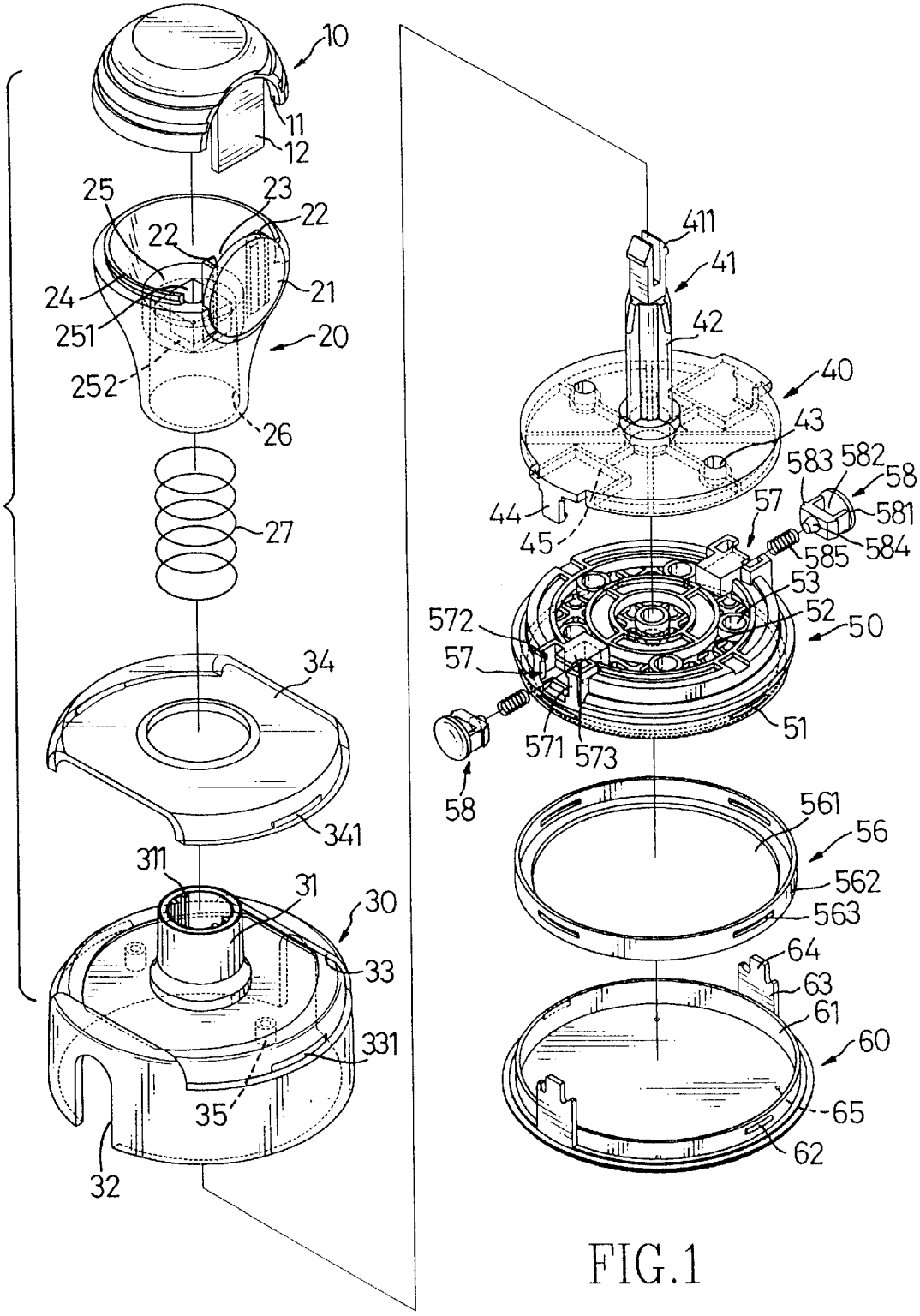
FIG. 1 is an exploded perspective view of an ink refillable stamp in accordance with the invention.
Figure 2:
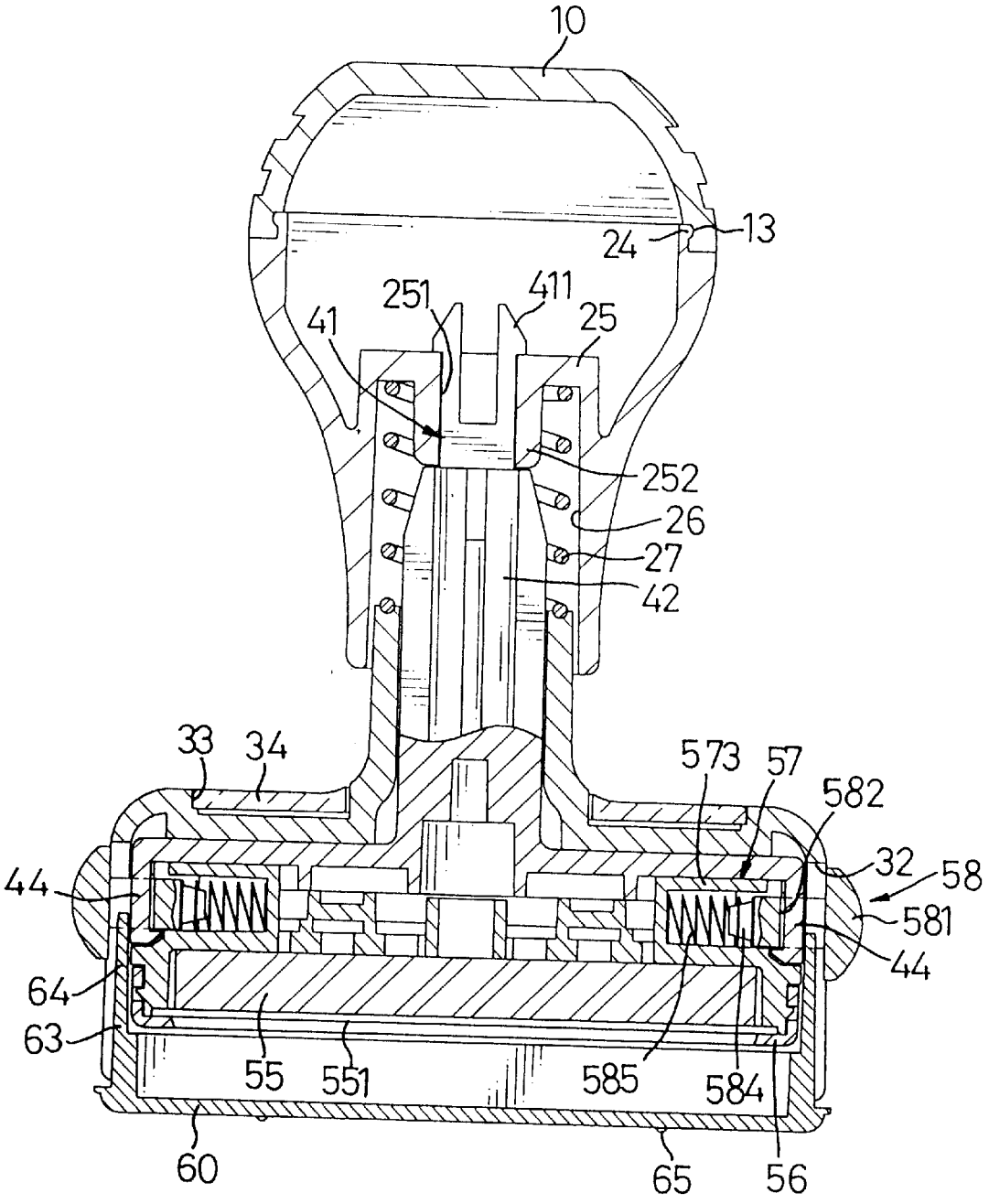
FIG. 2 is a cross sectional view of the ink refillable stamp in accordance with the invention.

Referring to FIGS. 1 and 2, an ink refillable stamp in accordance with the present invention is composed of a cap (10), a handle (20), a housing (30), an upper seat (40), a lower seat (50) and a bottom cover (60).

The cap (10) has a first notch (11) defined at a periphery thereof and a tab (12) formed in the notch (11) and extending downwards. A circular groove (13) is defined at a bottom of the cap (10).

The handle (20) has a cutout (21) vertically defined in an outer periphery thereof Two first ears (22) defining a channel (23) therebetween are formed on an upper edge of the cutout (21). The tab (12) extends through the channel (23) and urges against the cutout (21). A first ring (24) is formed on an upper surface of the handle (20) and received in the groove (13) of the cap (10). The handle (20) further has a passage (26) longitudinally defined therethrough and a flange (25) formed at an inside end of the passage (26). The flange (25) has a square orifice (251) defined through a square block (252) extending in the passage (26). A first resilient member (27) is received in the passage (26) with an upper end thereof provided between the passage (26) and the square orifice (251).

Figure 5:
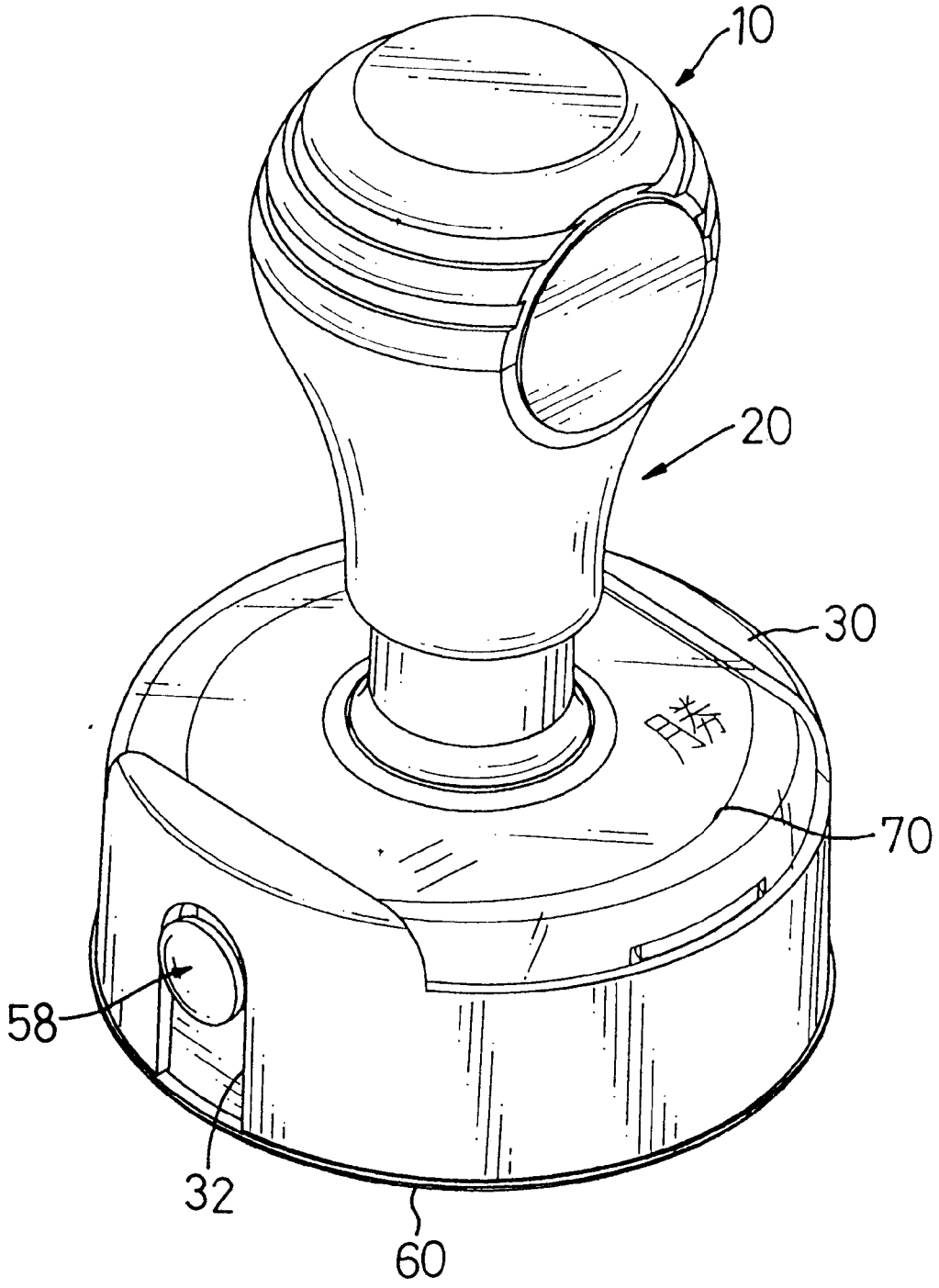
FIG. 5 is a perspective view of the ink refillable stamp in accordance with the invention.

The housing (30), of which a cross section is inverted U-shaped, has a tubular portion (31) formed upright on an upper surface thereof. The tubular portion (31), of which an outer diameter equals an inner diameter of the passage (26), is received in the passage (26) and has a plurality of first ribs (311) longitudinally formed on an inner wall thereof Two second notches (32) are diametrically oppositely defined through an outer periphery of the housing (30) and a recess (33) is defined at the upper surface of the housing (30). A transparent cover (34) is provided on the recess (33) with a first stop (341) which is formed on an inner wall thereof received in a first slot (331) defined in the recess (33). An information element (70), such as a piece of paper, printed with a stamping pattern can be provided between the cover (34) and the recess (33), as shown in FIG. 5, to help a user identify easily the information printable by the stamp and its appropriate direction. The housing (30) further has a plurality of pins (35) formed in an upper wall.

The upper seat (40), which is received in the housing (30), has a pole (41) formed upright on an upper surface thereof and the pole (41) extends through the tubular portion (31) and the passage (26). The pole (41) has a shaft (42) urging against the square block (252), and two barbs (411) formed at a top end of the shaft (42). The barbs (411) extend through the square orifice (251) to attach on the flange (25). A plurality of pin holes (43) corresponding to the pins (35) is defined in the upper surface of the upper seat (40) for receiving the pins (35) therein. Two hooks (44) are diametrically oppositely formed on an outer periphery of the upper seat (40). Two cavities (45) are defined in an upper inside wall of the upper seat (40) and beside the hooks (44) respectively.

Figure 3:
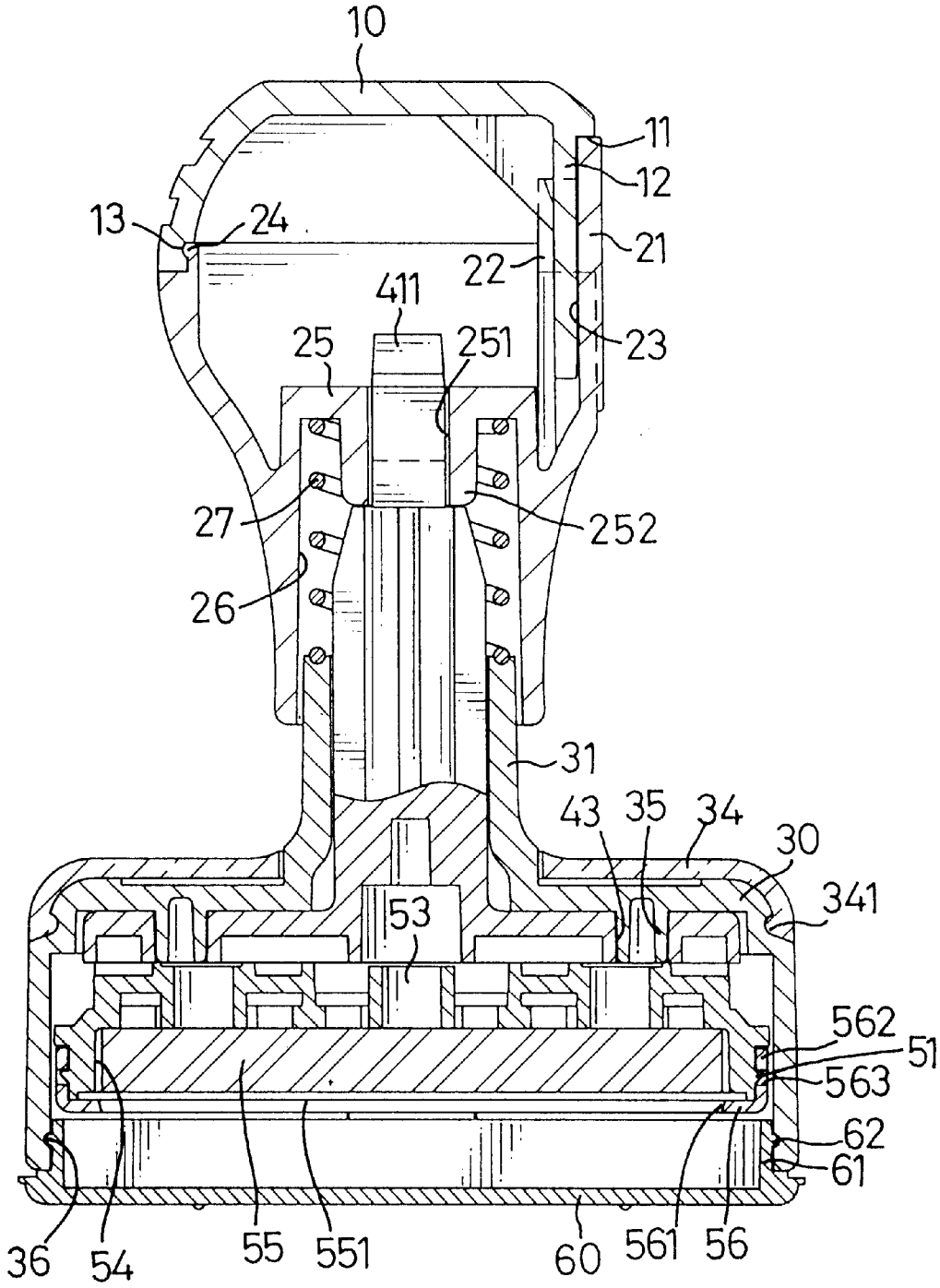
FIG. 3 is another cross sectional view of the ink refillable stamp.

Referring to FIGS. 1–3, the lower seat (50) has a plurality of second stops (51) formed on an outer periphery thereof and second ribs (52) formed on an upper surface thereof. A plurality of ink inlets (53) equally-spaced on a pitch circle diameter is defined through the lower seat (50) and in communication with a chamber (54) defined in a bottom of the lower seat (50). A sponge (55) is received in the chamber (54) and a stamping sheet (551) is provided beneath the sponge (55). A hoop (56) with an opening (561) has a plurality of second slots (563) defined in an outer periphery (562) thereof. The second stops (511) are respectively received in the second slots (563). The hoop (56) further has a rim (not numbered) formed at a bottom portion thereof to hold the stamping sheet (551).

Figure 4:
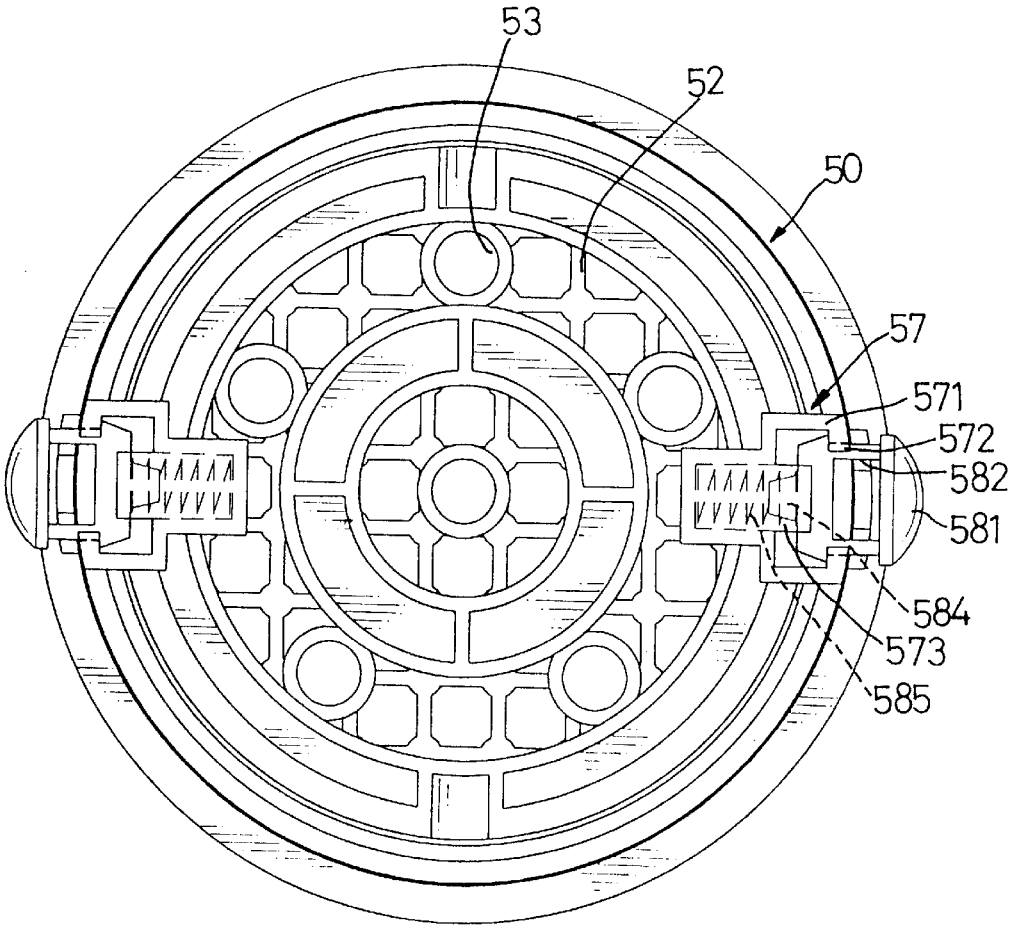
FIG. 4 is a top view of a lower seat of the ink refillable stamp.

Two compartments (57) are diametrically oppositely defined at the outer periphery of the lower seat (50). The compartments (57) are T-like with a narrow inside room and a wide outside room. Specially referring to FIG. 4, each of the compartments (57) has two side walls (571) and two stop walls (572) respectively formed at opposite sides of the outside room thereof, and a top wall (573) formed at the inside room thereof. Two buttons (58) are respectively received in the compartments (57) and each button (58) has a head (581), an aperture (582) defined through a body (583) tapered from the aperture (582) to a distal end, and a finger (584) formed on the distal end. Two second resilient members (585) are respectively received in the compartments (57) and fixed on the fingers (584). The buttons (58) are respectively and movably received in the wide outside portions of the compartments (57) by the second resilient members (585) pushing the bodies (583) against the stop walls (572) to enable the buttons (58) to be pushed inwards.

Referring back to FIGS. 1–4, the hooks (44) of the upper seat (40) are respectively inserted through the apertures (582) of the buttons. (58) and pushed against inner walls of the apertures (582) under the force of the second resilient members (585) and attach bottom surfaces of the bodies (583) to mount the upper seat (40) on the lower seat (50). The buttons (58) are respectively received in the second notches (32) of the housing (30). When the buttons (58) are pushed inwards, the hooks (44) can be retracted from the apertures (582) to disassemble the upper seat (40) from the lower seat (50).

Figure 7:
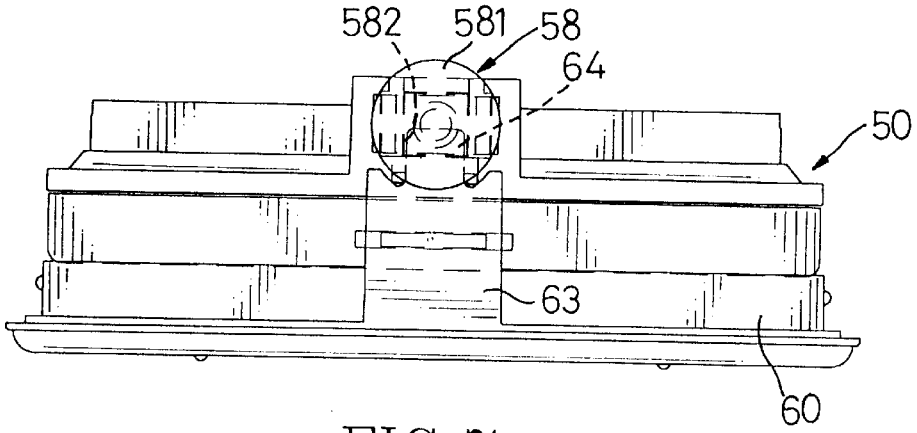
FIG. 7 is a front view of the lower seat and a bottom cover of the ink refillable stamp for refilling ink.

The bottom cover (60) is provided beneath the lower seat (50) and has a second ring (61) with a plurality of third stops (62) formed thereon and received in a third slot (36) defined on an inner wall of the housing (30), as shown in FIG. 3. Two second ears (63) are diametrically oppositely formed on the second ring (61) and each have a narrow portion (64) formed on a top end thereof. The second ears (63) are respectively provided at the second notches (32) with the narrow portions (64) inserted in the apertures (582) of the button (58), as shown in FIG. 7. The bottom cover (60) further has a plurality of protrusions (65) formed on a bottom surface thereof.

In assembly, the pole (41) is firstly inserted through the housing (30) to engage in the handle (20) to mount the upper seat (40) in the housing (30), and the cap (10) is mounted on the handle (20). Secondly, the lower seat (50) with the hoop (56) is mounted on the upper seat (40) by the hooks (44) being received in the buttons (58). Afterwards, the bottom cover (60) is mounted on the lower seat (50). The assembled stamp is shown in FIG. 5.

Figure 6:
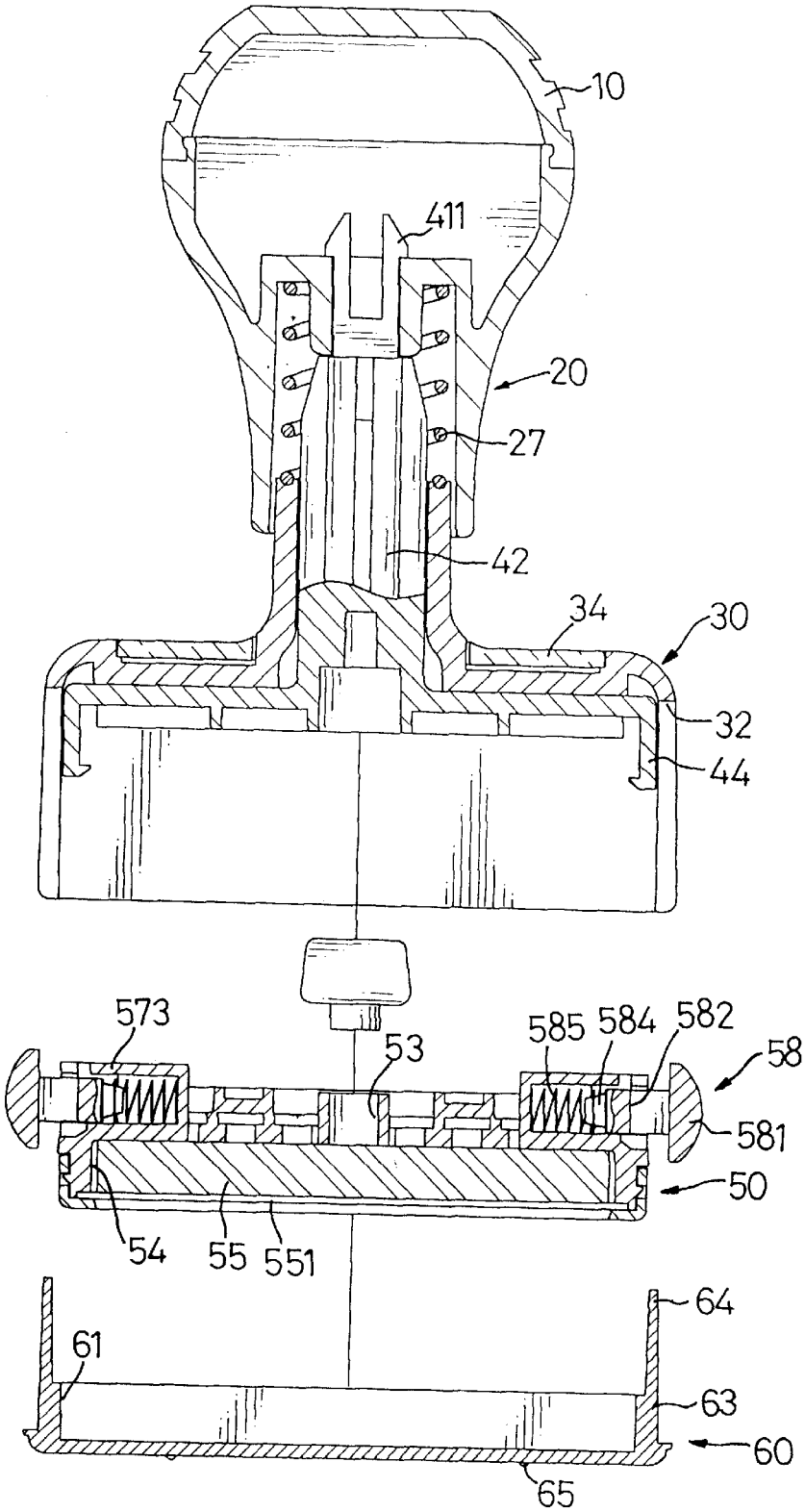
FIG. 6 is an exploded sectional view of the ink refillable stamp when being refilled with ink.
Figure 8:
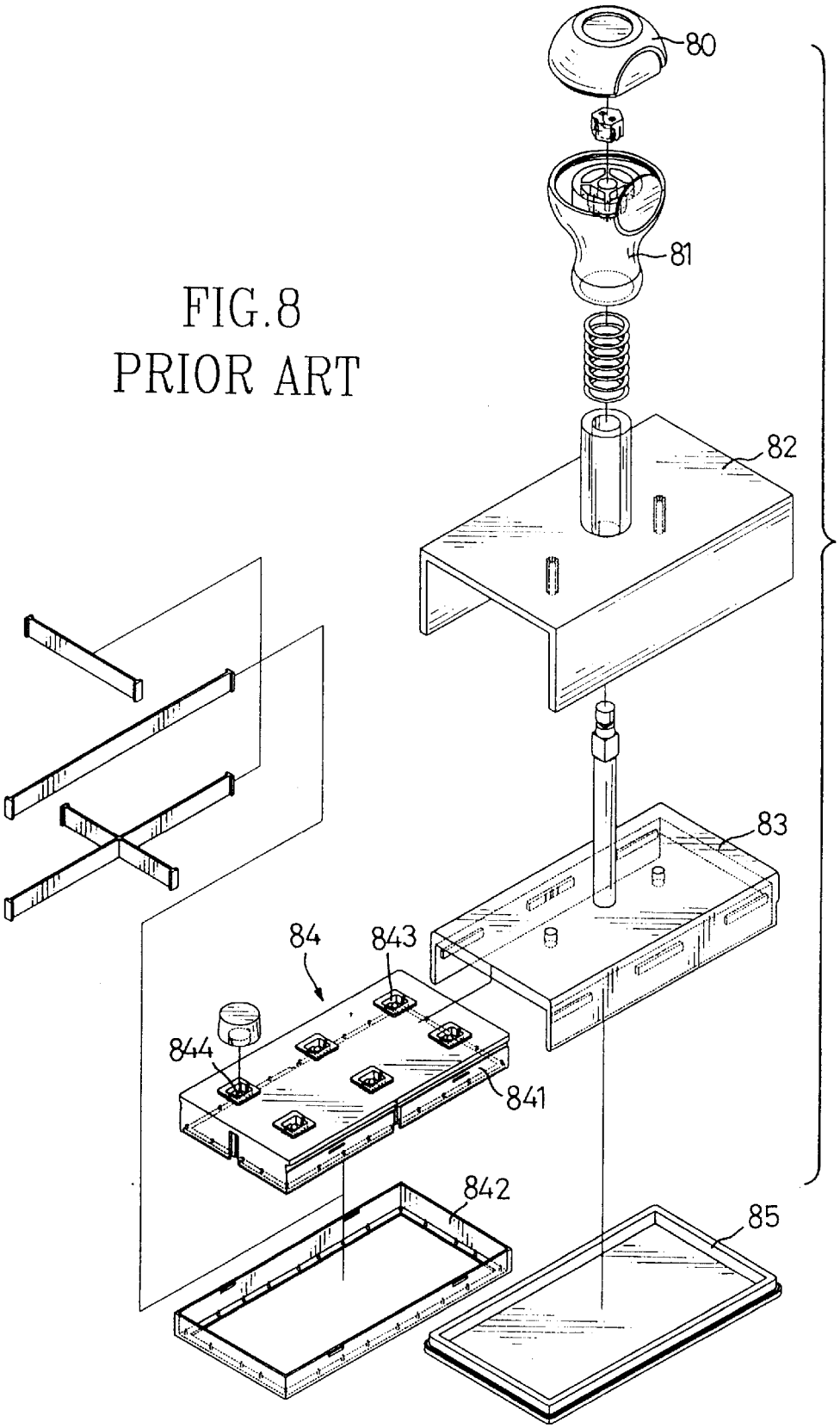
FIG.8 PRIOR ART
FIG. 8 is an exploded perspective view of a conventional ink refillable stamp.
Figure 9:
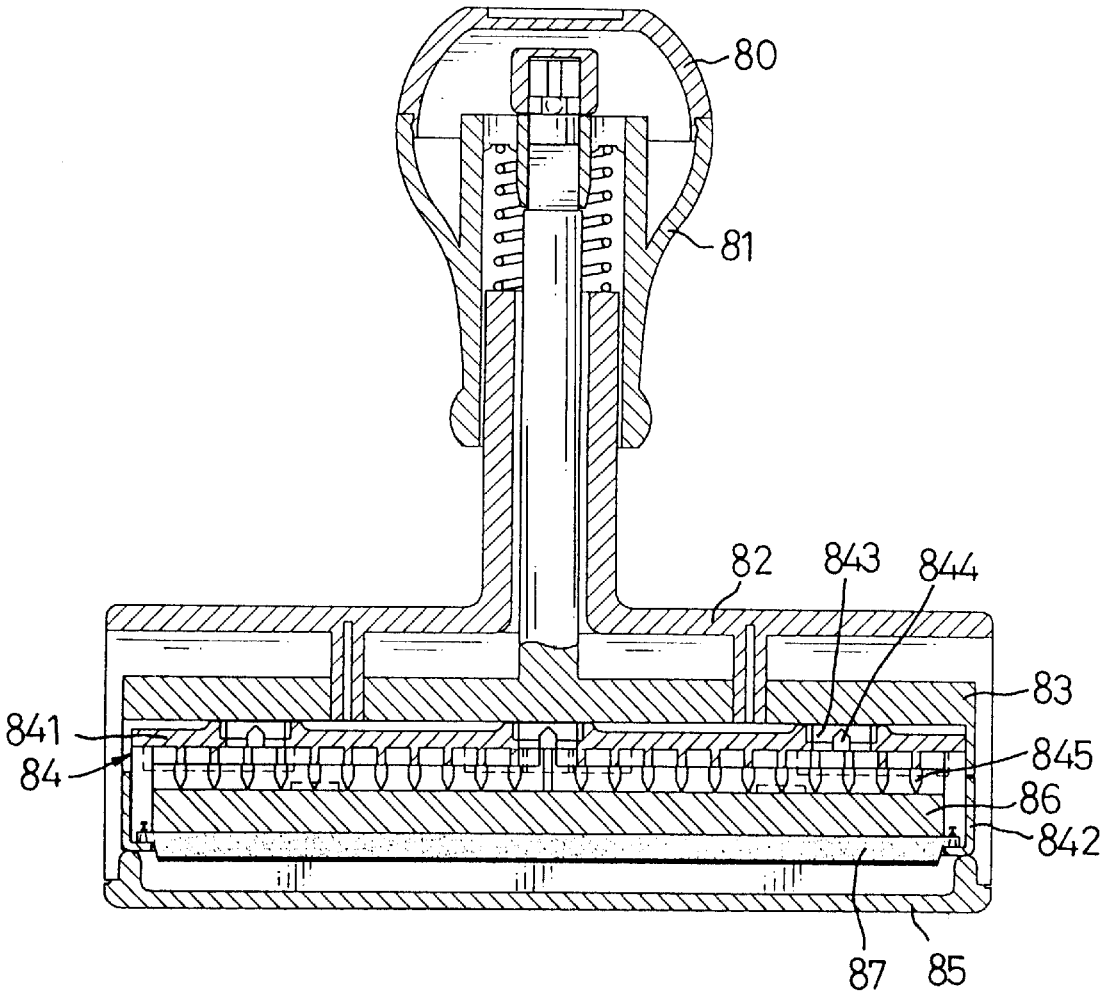
FIG.9 PRIOR ART
FIG. 9 is a cross sectional view of the conventional stamp.

Referring to FIG. 6, when the stamp need to be refilled with ink, the buttons (58) are pressed inwards to disengage the lower seat (50) from the upper seat (30). At this time the bottom cover (60) is still provided on the lower seat (50), with the narrow portions (64) being received in the apertures (582). Afterwards, ink bottles can be inverted and aligned with the ink inlets (53) and ink is poured into the chamber (54) and absorbed by the sponge (55).

From the above description, it is noted that the invention has the following advantages:

1. Because the lower seat is longitudinally disassembled from the upper seat, the lower seat with the stamping sheet can be formed with various configurations according to a user's desire and other elements of the stamp also can be adapted to the lower seat. Thus, it is very convenient for the user to correctly position the stamping pattern.

2. It is easy for the user to disassemble the lower seat from the upper seat for ink refilling by pressing the buttons to detach the hooks from the apertures.

3. The paper provided on the housing can help the user to correctly position the stamping pattern further.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An ink refillable stamp comprising:

a cap (10);

a handle (2) mounted under the cap (10) and having a passage (26) defined therein and a first resilient member (27) received in the passage (26);

a housing (30) having a tubular portion (31) formed on a top surface thereof and received in the passage (26);

an upper seat (40) received in the housing (30) and having a pole (41) formed on a top surface and extending through the tubular portion (31) and the passage (26) and engaged in the handle (20);

a lower seat (50) detachably mounted beneath the upper seat (40) and having a hoop (56) detachably mounted to the bottom of the lower seat, a plurality of ink inlets (53) formed through a top surface thereof, a chamber (54) defined at a bottom portion thereof and in communication with the ink inlets (53), a sponge (55) received in the chamber (54), and a stamping sheet (551) secured between the hoop (56) and the lower seat (50) under the sponge (55); and, a bottom cover (60) provided on the lower seat (50).

2. The ink refillable stamp as claimed in claim 1, wherein the cap (10) has a first notch (11) defined at an outer periphery thereof and a tab (12) formed in the notch (11) and extending downwards;

the handle (20) has a cutout (21) vertically defined on an outer periphery thereof, and two first ears (22) defining a channel (23) therebetween formed on an upper edge of the cutout (21), wherein the tab (12) extends through the channel (23) and urges against the cutout (21).

3. The ink refillable stamp as claimed in claim 1, wherein the cap (10) has a circular groove (13) defined at a bottom face thereof; and the handle (20) has a first ring (24) formed on an upper surface thereof and received in the groove (13) of the cap (10).

4. The ink refillable stamp as claimed in claim 1, wherein the handle (20) has a flange (25) formed at an inside end of the passage (26) and having a square orifice (251) defined through a square block (252) extending in the passage (26); and the pole (41) has at least one barb (411) formed at a top end thereof and extending through the square orifice (251) and attaching on the flange (25).

5. The ink refillable stamp as claimed in claim 1, wherein the housing (30) further has a plurality of pins (35) formed on an upper wall thereof, and the upper seat (40) has a plurality of pin holes (43) defined in the upper surface thereof to receive the pins (35) therein.

6. The ink refillable stamp as claimed in claim 1, wherein the housing (30) has a recess (33) defined in the upper surface thereof, a transparent cover (34) provided on the recess (33) and an information element (70) with a stamping pattern thereon provided between the cover (34) and the recess (33).

7. The ink refillable stamp as claimed in claim 6, wherein the recess (33) has a first slot (331) defined therein, and the cover (34) has a first stop (341) formed on an inner wall thereof and received in the slot (331).

8. The ink refillable stamp as claimed in claim 1, wherein the upper seat (40) has two hooks (44) diametrically oppositely formed on an outer periphery thereof;

the lower seat (50) has two compartments (57) diametrically oppositely defined at an outer periphery thereof and two buttons (58) respectively received in the compartments (57), wherein the hooks (44) are respectively detachably fastened in the buttons (58).

9. The ink refillable stamp as claimed in claim 8, wherein the compartments (57) each being composed of a narrow inside room and a wide outside room have two opposite side walls (571) and two stop walls (572) formed at the outside room, and a top wall (573) formed at the inside room;

the buttons (58) each have a head (581), an aperture (582) defined through a body (583) tapered to a distal end, a finger (584) formed on the distal end, and a second resilient member (585) provided in the inside room and fixed on the finger (584), wherein the bodies (583) of the buttons (58) are pushed against the stop walls (572) under the force of the second resilient members (585), and the hooks (44) are received in the apertures (582).

10. The ink refillable stamp as claimed in claim 8, wherein the upper seat (40) has two cavities (45) respectively defined beside the hook (44) and at a bottom surface thereof.

11. The ink refillable stamp as claimed in claim 1, wherein the lower seat (50) has a plurality of second stops (511) formed on an outer periphery thereof and the hoop (56) has a plurality of second slots (563) defined in an outer periphery (562) thereof for the stops (511) to be received therein.

12. The ink refillable stamp as claimed in claim 8, wherein the bottom cover (60) has two second ears (63) formed an outer periphery thereof and extending upwards and fixed in the lower seat (50), and the housing (30) has two second notches (32) diametrically oppositely defined at an outer periphery thereof for respectively receiving the buttons (58) and the second ears (63).

13. The ink refillable stamp as claimed in claim 12, wherein the ears (63) each have a narrow portion (64) formed thereon and each narrow portion (64) is received in the aperture (582) of the button (58).

14. The ink refillable stamp as claimed in claim 12, wherein the bottom cover (60) has a plurality of third stops (62) formed on an outer periphery thereof, and the housing (30) has a third slot (36) defined on an inner wall thereof for receiving the third stops (62) therein.

15. The ink refillable stamp as claimed in claim 1, wherein the bottom cover (60) has a plurality of protrusions (65) formed on a bottom surface thereof.

* * * * *